US007582838B2

(12) United States Patent
Sharrah

(10) Patent No.: US 7,582,838 B2
(45) Date of Patent: Sep. 1, 2009

(54) FLASHLIGHT ELECTRICAL SWITCH AND CHARGING INDICATOR

(75) Inventor: Raymond L. Sharrah, Collegeville, PA (US)

(73) Assignee: Streamlight, Inc., Eagleville, PA (US)

( * ) Notice: Subject to any disclaimer, the term of this patent is extended or adjusted under 35 U.S.C. 154(b) by 667 days.

(21) Appl. No.: 11/400,615

(22) Filed: Apr. 6, 2006

(65) Prior Publication Data

US 2007/0235308 A1 Oct. 11, 2007

(51) Int. Cl.
*H01H 9/16* (2006.01)

(52) U.S. Cl. ..... 200/310; 200/60; 200/317; 362/205

(58) Field of Classification Search ..... 200/5 R, 200/5 A, 17 R, 18, 296, 60, 310–317, 293.1; 362/202, 396, 183, 184, 194, 205, 206, 204, 362/802, 158, 251; 429/97
See application file for complete search history.

(56) References Cited

U.S. PATENT DOCUMENTS 4,177,500 A 12/1979 Nicholl et al.
5,359,779 A 11/1994 Polk
5,473,517 A 12/1995 Blackman
5,486,432 A 1/1996 Sharrah et al.
5,629,105 A 5/1997 Matthews
5,667,293 A * 9/1997 Own ..... 362/184
5,772,309 A 6/1998 Groben
5,871,272 A 2/1999 Sharrah et al.
6,222,138 B1 4/2001 Matthews
6,250,771 B1 6/2001 Sharrah et al.
6,278,071 B1 * 8/2001 Chen ..... 200/302.1
6,296,367 B1 10/2001 Parsons
6,523,972 B2 2/2003 Sharrah et al.
6,857,756 B2 * 2/2005 Reiff et al. ..... 362/184
6,974,222 B2 * 12/2005 Mascadri et al. ..... 362/85
7,011,423 B2 * 3/2006 Chen ..... 362/102
7,090,373 B2 * 8/2006 Lai ..... 362/202
7,125,140 B2 * 10/2006 Koch et al. ..... 362/205
7,293,898 B2 * 11/2007 Kumthampinij et al. .... 362/294
RE40,027 E * 1/2008 Matthews ..... 429/97
7,441,920 B2 * 10/2008 Kang et al. ..... 362/205

(Continued)

OTHER PUBLICATIONS

Streamlight, Inc., "Revolutionary patent technology: The LED/incandescent combination lets you choose a super-bright beam or an incredible long runtime," SH-20XP/LED & 3C-XP Information, http://www.streamlight.com/s120xp_led-3cxp_info.htm, Printed Mar. 31, 2006, 2 Pages.

(Continued)

*Primary Examiner*—Michael A Friedhofer
(74) *Attorney, Agent, or Firm*—Clement A. Berard, Esq.; Dann, Dorfman, Herrell & Skillman, PC

(57) ABSTRACT

An electrical switch arrangement comprises at least one actuator for selectively making and breaking an electrical connection between electrical contacts thereof, and an indicator light source for selectively producing light. A switch housing supports the actuator so that the actuator may be actuated, and covers the indicator light source. The switch housing is translucent and/or transparent to light produced by the indicator light source so that the indicator light source is visible through the switch housing when the indicator light source is producing light.

31 Claims, 4 Drawing Sheets

U.S. PATENT DOCUMENTS

2002/0021573 A1 2/2002 Zhang

OTHER PUBLICATIONS

Streamlight, Inc., "SL-20XP™ /LED (Rechargeable)," SL-20XP/LED & 3C-XP Specifications, http://www.streamlight.com/sl120xp_led-3cxp_specs.htm, Printed Mar. 31, 2006, 2 Pages.
Streamlight, Inc., "SL-20XP-LED (Rechargeable) Operating Instructions," No Date, 6 Pages.
Garrity Lites, Rechargeable Flashlight, http://www.garritylites.com/page94.html, date unknown, printed Jun. 29, 2009, 1 page.
Garrity Lites, Rechargeable Flashlight with Night Light, http://www.garritylites.com/page96.html, date unknown, printed Jul. 1, 2009, 1 page.
Garrity Lites, Rechargeable LED Flashlight with Night Light, http://www.garritylites.com/page613.html, date unknown, printed Jul. 1, 2009, 1 page.
Garrity Lites, Rechargeable LED Lantern with Night Light, http://www.garritylites.com/page616.html, date unknown, printed Jul. 1, 2009, 2 pages.
Garrity Lites, Rechargeable LED Flashlight with Night Light, http://www.garritylites.com/page620.html, date unknown, printed Jul. 1, 2009, 1 page.
On the Go Backpacks, Streamlight SL 20X Rechargeable Flashlight, http://www.onthegobackpacks.com/product/ST20201?gdftrk=gdfV2565_a_7c665_a_7c2663_a_7cST20201, date unknown, printed Jun. 29, 2009, 1 page.

* cited by examiner

FLASHLIGHT ELECTRICAL SWITCH AND CHARGING INDICATOR

The present invention relates to an electrical switch and, in particular, to an electrical switch providing a charging indication.

Electrical appliances having a rechargeable battery as a source of power rely on the battery being properly charged both initially and after use, so as to be ready for use at another time. Battery charging is usually accomplished by placing the appliance into a charger, e.g., in the form of a charging stand or a charging dock, which is connected to another source of electrical power, typically a utility electrical power outlet or a vehicle electrical power outlet Some appliances include charging circuitry that is built in and so the appliance may be directly plugged into the other source of electrical power. The charger converts the utility power, e.g., at 110 volts AC or 220 volts AC, into a voltage suitable for recharging the low voltage battery of the appliance, e.g., 6-12 volts AC or DC, as the case may be.

Examples of rechargeable battery-operated appliances include flashlights, for example, and may also include such appliances as electric toothbrushes, electric shavers, portable vacuums, and the like.

Many such appliances have a charging indicator such as a small light that illuminates when the appliance is "being charged." In many instances, the charging light is part of the charger and illuminates when the battery-operated appliance is placed on or into the charger, in some cases irrespective of whether the battery is actually receiving charging power. Thus, merely placing an appliance in its charger may cause the charging indicator light to illuminate even though the battery may not be receiving charge.

Particularly in the case of flashlights for use by police, fire, first responders, emergency personnel, military personnel, security personnel, and the like, expecting a flashlight or other appliance to be fully charged when it is not could lead to life and property being placed at risk, if not to an injury, a loss of life and/or a destruction of property.

Preferably, a charging indicator is part of the battery operated appliance and is arranged to illuminate only when power to charge the battery is being received by the appliance. Many charging indicators are relatively small and so are difficult to see, particularly from a wide range of viewing angles, and so sometimes plural charging indicators may be employed to overcome this problem. Plural indicators conventionally are provided by plural light sources, typically light-emitting diodes (LEDs) and their current determining circuits, which undesirably increases the cost of the appliance.

Accordingly, there is a need for an electrical switch and charging indicator that addresses one or more of the foregoing shortcomings.

To this end, an electrical switch arrangement may comprise at least one actuator for actuating at least one set of electrical contacts for selectively making and breaking an electrical connection, an indicator light source proximate the actuator for selectively producing light, and a translucent and/or transparent switch housing supporting the actuator so that the actuator may be actuated, the translucent and/or transparent switch housing covering the indicator light source so that the indicator light source is visible through the translucent and/or transparent switch housing when the indicator light source is producing light.

BRIEF DESCRIPTION OF THE DRAWING

The detailed description of the preferred embodiment(s) will be more easily and better understood when read in conjunction with the FIGURES of the Drawing which include.

Figure 1:
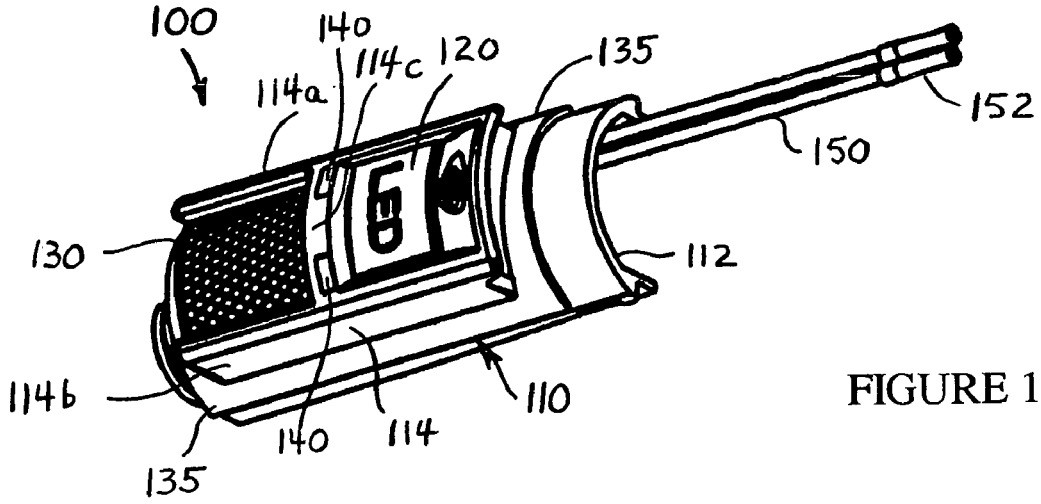
FIG. 1 is an isometric view of an example embodiment of a electrical switch, in particular, showing the side thereof that would be exterior a flashlight.

In the Drawing, where an element or feature is shown in more than one drawing figure, the same alphanumeric designation may be used to designate such element or feature in each figure, and where a closely related or modified element is shown in a figure, the same alphanumerical designation primed or the like may be used to designate the modified element or feature. Similarly, similar elements or features may be designated by like alphanumeric designations in different figures of the Drawing and with similar nomenclature in the specification. It is noted that, according to common practice, the various features of the drawing are not to scale, and the dimensions of the various features are arbitrarily expanded or reduced for clarity, and any value stated in any Figure is given by way of example only.

DESCRIPTION OF THE PREFERRED EMBODIMENT(S)

Figure 2:
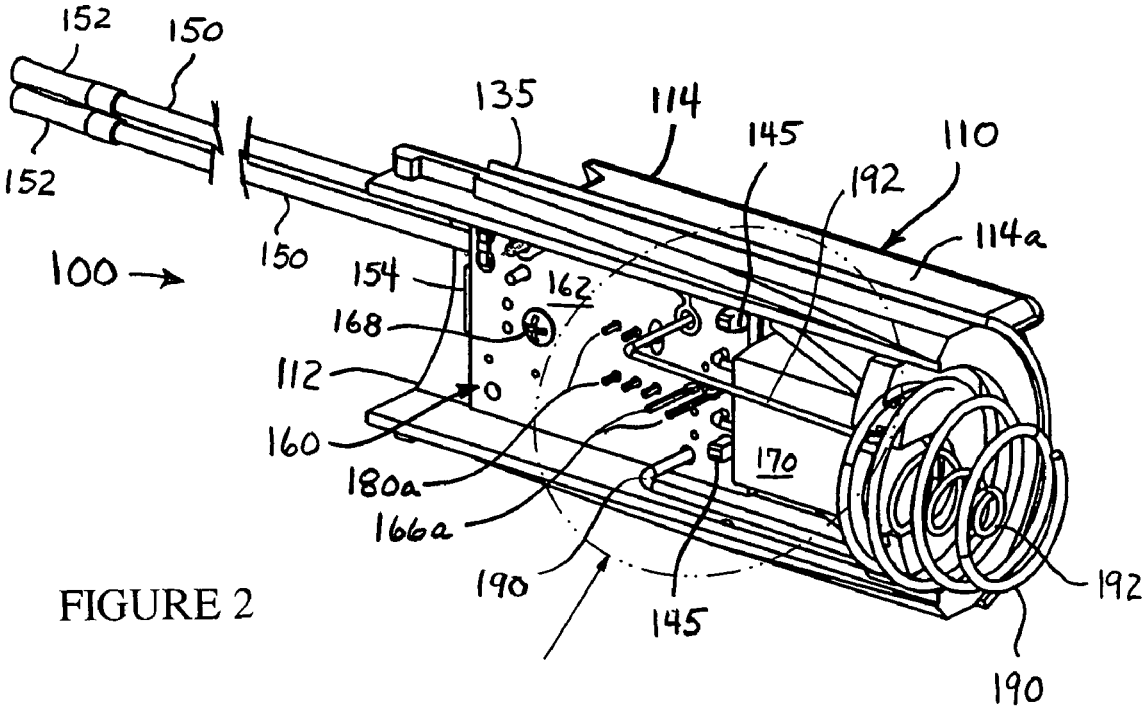
FIG. 2 is an isometric view of the example embodiment of a electrical switch shown in FIG. 1, in particular, showing the side thereof that would be interior the flashlight.

FIG. 1 is an isometric view of an example embodiment of an electrical switch 100, in particular, showing the side thereof that would be exterior a flashlight (or appliance) and so would be seen by a user thereof, and FIG. 2 is an isometric view of the example embodiment of the electrical switch 100 shown in FIG. 1, in particular, showing the side thereof that would be inside the housing of the flashlight (or appliance).

Electrical switch 100 comprises a housing 110 comprising a back structure 112 that preferably is shaped to conform to the interior surface of a flashlight or appliance (not shown), and a bezel or frame 114 that preferably is exposed through an opening in the flashlight or appliance when switch 100 is used therewith. A gasket 135 of a shape that generally conforms to the shape of backing structure 112 and surrounds the periphery of bezel 114 may be provided for providing a seal for the opening in the appliance or light around the opening therein in which bezel 114 of housing 110 is disposed.

Switch 100 includes at least one actuator 120, 130 for an electrical switch 170, 180, wherein the at least one actuator 120, 130 is exposed so as to be operable by a user when switch 100 is utilized with a flashlight or appliance. In particular, bezel 114 defines a preferably transparent or translucent frame for exposed actuator buttons 120, 130, and transparent or translucent bezel 114 also provides areas for light emitted by a charging light interior to switch 100 to pass to provide a charging indicator.

In the example embodiment illustrated, switch 100 includes two actuator buttons 120, 130 that are exposed so as to be operable by a user for actuating electrical switches 170 and 180, respectively, not visible in FIG. 1. On a central portion 114*c* of bezel 114 between actuator buttons 120 and 130 are two charging contacts 140 that connect to corresponding respective contacts of a charging station when the appliance or light including switch 100 is therein for conducting charging current for charging the rechargeable battery of the appliance or light.

Interior to switch 100 in a generally central location, e.g., behind central portion 114*c* of bezel 114, is a light source (not directly visible in FIGS. 1 and 2) that illuminates when the rechargeable battery of the appliance or light including switch 100 is charging, and the light produced thereby is visible through bezel 114 of housing 110 which is translucent or is transparent or is translucent and transparent to such light. Because at least bezel 114 is transparent or translucent, the light produced by the charging indicator internal to switch 100 is visible through opposing sides 114*a* and 114*b* of bezel 114, as well as through central portion 114*c* thereof.

The charging indicator light (not visible) preferably may be part of an electronic printed wiring circuit board 160 that is attached to the back structure 112 of housing 110, e.g., by a fastener, such as screw or bolt 168. Electronic circuit board 160 may also receive respective charging contact posts 145 that extend from charging contacts 140 to carry battery charging current via circuit board 160 and contact spring 192 to a relatively positive terminal of a rechargeable battery and via circuit board 160 and contact spring 190 to a relatively negative terminal of the rechargeable battery.

In one example embodiment, contact springs 190, 192 have respective coiled portions that are concentric and extend axially from switch 100 for making electrical contact with concentric or other spaced apart terminals of a rechargeable battery. In such embodiment, back structure 112 of housing 110 preferably includes projections and/or recesses 119, 119*g* that substantially maintain a desired concentricity and spacing between springs 190 and 192.

Switch 100 typically has electrical conductors such as wires 150 for making electrical connections to a light source or other operating device of a light or appliance including switch 100. In an example embodiment comprising a flashlight 10 that includes a solid state (LED) light source 64 and an incandescent halogen lamp 52 (e.g., as in FIGS. 3 and 4), two wires 150 are provided extending from circuit board 160, each wire preferably having an electrical connector 152 on the end thereof remote from circuit board 160 for facilitating their connection to the respective pins or leads of the incandescent halogen lamp 52. Smaller wires may be provided for connecting from circuit board structure 160 to the LED light source 64 (not shown in FIGS. 1 and 2) of flashlight 10, and such wires may conveniently connect thereto via a connector 154 included on circuit board 162.

Because a halogen lamp typically operates at a higher current level than does an LED, ON/OFF switch 170 for the halogen lamp is typically relatively larger and may be disposed at any convenient location in or adjacent back structure 112 of switch housing 110. The ON/OFF switch for the LED light source (only switch leads 180*a* and indicator LED leads 166*a* are visible) is relatively smaller and so may be mounted on circuit board 160.

One example embodiment of switch 100 for a flashlight has a housing molded of a relatively dark-red-color translucent ABS or polycarbonate or other suitable plastic that appears almost black when switch 100 is mounted in the flashlight. Therein, a single red-light emitting LED is mounted on printed wiring board 160 in a position such that is generally centrally located substantially between charging posts 145 when printed circuit board 160 is mounted in housing 110 so that, illumination produced by the LED passes through sides 114*a*, 114*b* and central portion 114*c*.

Alternatively, it is satisfactory that bezel 114, or at least sides 114*a*, 114*b* and central portion 114*c* thereof, be of a suitable transparent or translucent material, thereby to provide substantially the illuminating indicator feature. Pushbutton actuators 120, 130 and cover gasket 135 may be molded of rubber, synthetic rubber, silicone rubber, neoprene, Santoprene® elastomer, Kraton® polymer, Alcryn® synthetic rubber, or of an elastomer or polymer, or of another suitable flexible and resilient material.

Figure 3:
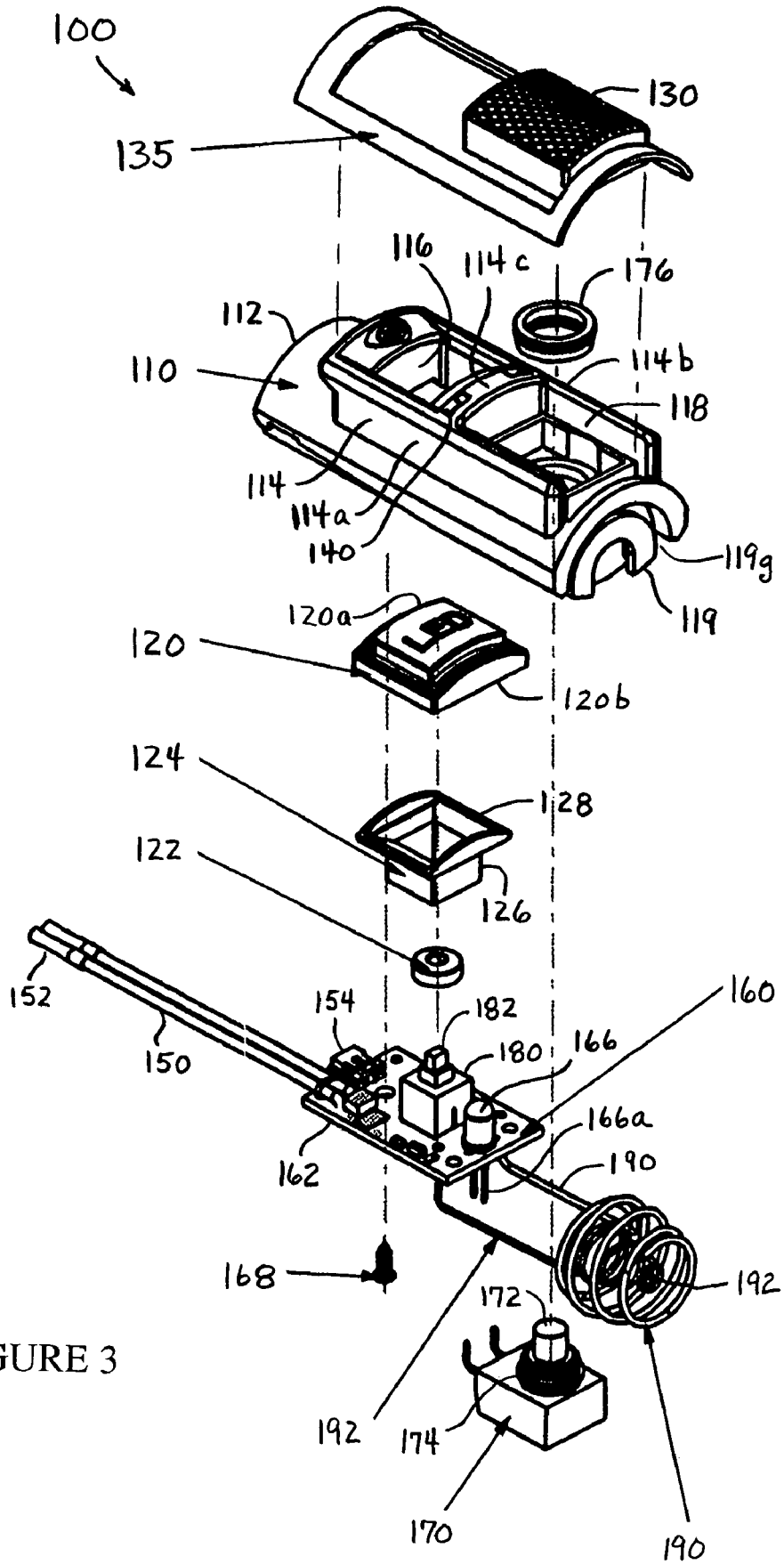
FIG. 3 is an exploded isometric view of the example embodiment of a electrical switch as illustrated in FIGS. 1 and 2.

FIG. 3 is an exploded isometric view of the example embodiment of a electrical switch 100 as illustrated in FIGS. 1 and 2. Details of switch 100, switch housing 110, and parts thereof, that may have been hidden in FIG. 1 and/or FIG. 2 are visible in FIG. 3.

Appliance or light body 20 is seen to have a shape, e.g., a curved shape, to which that of back structure 112 of switch housing 110 generally corresponds or conforms. Body 20 is seen to have an opening 26 therein of a size and shape for receiving bezel 114 of switch 100, whereby switch 100 may be mounted against body 20 with bezel 114 exposed through opening 26 of body 20, if not extending into and/or through opening 26. In an example wherein body 20 represents a flashlight, a halogen lamp 52 and an LED 64 may be provided at one end thereof for providing illumination when energized by operation of switch 100, with or without a reflector to shape or form the illumination into a beam.

Lamp button 130 and gasket 135 may be separate pieces or may be an integral unit (as illustrated), and may be molded from any suitable flexible and resilient material, such as rubber, synthetic rubber, silicone rubber, neoprene, Santoprene® elastomer, Kraton® polymer, Alcryn® synthetic rubber, or an elastomer or polymer. In the example illustrated, button 130 comprises a rectangular solid exterior shape that is joined at one side thereof to gasket 135 which is a generally rectangular annular gasket curved generally according to the surface of a cylinder, e.g., to conform with the generally cylindrical shape of housing back structure 112. Lamp button 130 may have ridges and grooves, bumps and valleys, a symbol representative of a function, or other suitable surface features for improved grip, for visual distinctiveness, for assisting a user, and/or for aesthetic purposes.

Switch housing 110 includes bezel or frame 114 having opposing sides 114*a*, 114*b* and central portion 114*c*, and defines two cavities 116, 118 for receiving actuator 182 of LED switch 180 and actuator 172 of lamp switch 170, respectively. Lamp ON/OFF switch 170 mounts from the back structure 112 side of switch housing 112 with pushbutton actuator 172 and threaded sleeve 174 thereof projecting through a hole in the bottom of cavity 118. Threaded collar or nut 176 threadingly engages threaded sleeve 174 to secure switch 170 to housing 110 with actuator button 172 behind lamp button 130, whereby applying force or pressure to flexible lamp button 130 results in force or pressure against actuator 172 for operating ON/OFF switch 170 to energize and/or de-energize lamp 52.

Circuit board structure 160 includes a printed wiring circuit board 162 on which various switches, light sources, an indicator, and other electronic components are mounted for providing control circuits for appliance and/or light 10. Circuit board 160 may be secured to switch housing 110 by any suitable fastening means 168, e.g., a bolt, a screw, a rivet, an adhesive, a clasp, a latch, and the like.

Indicator LED 166 is mounted on circuit board 162 in a position such that when circuit board 160 is positioned against back structure 112 of housing 110, LED 166 is positioned behind central portion 114*c* of bezel 114. Preferably, LED 166 is positioned between the two walls that extend from central portion 114*c* towards back structure 112 that define parts of cavities 116 and 118, and that also define a cavity opening in the back structure 112 into which LED 166 may extend when circuit board 160 is positioned in back structure 112 of switch housing 110. Because sides 114*a*, 114*b* and central portion 114*c* of bezel 114 are transparent or translucent, light produced by LED 166 is visible through opposing sides 114*a*, 114*b* and central portion 114*c* of bezel 114, whereby the indication provided by a single LED 166 may be viewed from a wide range of viewing positions. In addition, such visual indication is provided without the need for another hole or opening therefore in the body 20.

LED ON/OFF switch 180 is also mounted on circuit board 162. Actuator 182 of LED ON/OFF switch 180 extends from circuit board 160 into cavity 116 of switch housing 110 when circuit board 160 is positioned against back structure 112 thereof. Where actuator 182 is relatively small, a button 122 may be fitted on actuator 182 to provide a larger actuator surface behind flexible LED button 120. LED button 120 may have a smaller rectangular portion 120*a* that extends into cavity 116 of bezel 114 of switch housing 110 and a larger rectangular portion 120*b* that abuts or bears against housing 110 proximate the bottom of cavity 116.

Support box 124 has, for example, a lower portion 126 of a size and shape to slip over the body of switch 180 and has a larger upper portion that provides a partially straight and partially curved rectangular edge to fit inside the relatively larger lower portion 120*b* of LED button 120 and to bear against the periphery of the relatively smaller upper portion 120*a* thereof. Support box 124 thus serves to properly position LED button 120 in cavity 116 of bezel 114, to support LED button 120, and/or to properly align actuator 182 (and button 122, if utilized) with respect to LED button 120.

Switch housing 110 also includes a semicircular projection 119 or a semicircular grooves 119*g*, or both, at the end thereof whereat the concentric coiled portions of springs 190, 192 are disposed. Projection 119 and grooves 119*g* positively separate and space apart the respective concentric coiled portions of springs 190, 192 to maintain substantial concentricity and thereby prevent a short circuit therebetween. Projection 119 may have one or more grooves and/or indentations 119*g* therein, and/or one or more projections therefrom, to further support and locate springs 190, 192.

Optionally, circuit board structure 160 may also include electronic circuitry for controlling and/or regulating the charging of a rechargeable battery, for controlling the intensity of an incandescent lamp, for controlling the intensity of LED light sources, for controlling operation of incandescent and/or LED light sources for extending operating time and/or for protecting a battery from excessive discharge, and any other desired function.

Figure 4:
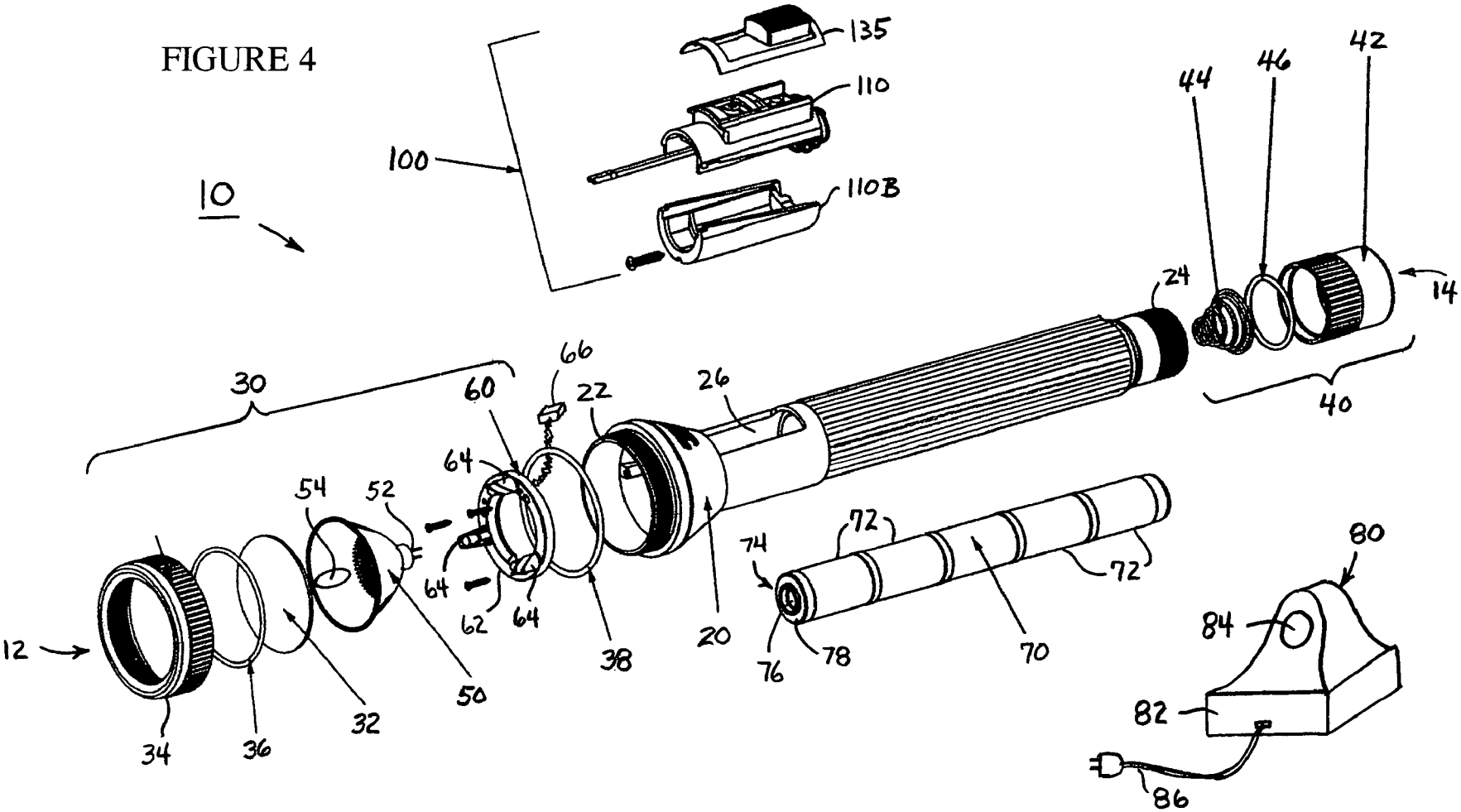
FIG. 4 is an exploded isometric view of an example flashlight including the example embodiment of a electrical switch as illustrated in FIGS. 1-3.

FIG. 4 is an exploded isometric view of an example flashlight 10 including the example embodiment of a electrical switch 100 as illustrated in FIGS. 1-3. Flashlight 10 comprises a generally cylindrical housing 20 having a light-producing head 30 at a head end 12 thereof and having a tail cap 40 at a tail or rear end 14 thereof.

Housing 20 has an opening 26 therein through switch 100 is mounted and may have ribs or knurling or other surface features to improve grip. Switch 100 is positioned in housing 20 with bezel 114 in opening 26 thereof and with switch back structure 112 of switch housing 110 adjacent the inner surface of housing 20. Switch mating structure 110B is slipped into housing 20 to urge switch 100 against the inner surface of housing 20, and may have drafts in the longitudinal direction that is complementary to the draft of switch back structure 112. Switch 100 and mating structure 110B may be secured in position by a screw 111 or other fastener. The shape of opening 26 preferably corresponds to that of bezel 114, e.g., both may be generally rectangular.

Light producing head 30 includes a reflector 50 in which are centrally located halogen lamp 52 and which has openings 54 for receiving LEDs 64. Face cap 32 threads onto the threaded forward end 22 of housing 20 to position and contain lens 32 and reflector 50 with respect to housing 20. LED light source 60 includes an annular plastic ring 62 that fits close behind reflector 50 to position three LEDs 64 supported by ring 62 in the corresponding openings 54 through reflector 50. Electrical wires and connector 66 of light source 60 connect to connector 154 of circuit board 160 within housing 20 for receiving electrical power for energizing LEDs 64. Optional O-rings 36 and 38 may provide sealing for face cap 34 against lens 32 and against housing 20.

Cylindrical housing 20 has a central cavity into which a battery 70 is placed. Battery 70 is preferably an assembly or package of plural battery cells 72, e.g., of five rechargeable battery cells 72, that is inserted into housing 20 with its contact end 74 towards head 30. A circular inner or central contact 76 of battery 70 is for contacting the inner concentric spring 192 of switch 100 and an annular circular outer or ring contact 78 thereof is for contacting outer concentric spring 190 of switch 100. Typically, central contact 76 is the relatively positive terminal of battery 70 and outer circular contact 78 is the relatively negative terminal of battery 70.

Tail cap assembly 40 includes a tail cap 42 that is threaded onto threaded end 24 of housing 20 and a coil spring 44 that urges battery 70 in a forward direction in housing 20, e.g., toward head 30. Optional O-ring provides sealing of tail cap 42 and housing 20.

Flashlight 10 may be slipped into a charger may be a charger sleeve 80 into which light 10 is inserted for charging, for recharging or for maintaining the charge of the rechargeable battery 70 of flashlight 10, or simply for storage. An example charger sleeve 80 has a base 82 that may be mounted to an object, e.g., to a wall or to an interior of a vehicle, in a convenient location. Charger 80 has an opening 84 of a shape corresponding to the shape of housing 20 which slips through opening 84 in a manner so that charging contacts 140 of switch 100 come into electrical contact with corresponding contacts within opening 84 of charger 80, so that the battery 70 of flashlight 10 may be charged. Charger 80 may include a connection 86 to a source of electrical power, e.g., via a line cord 86 for a 110-240 volt utility power main, and/or for a 12-48 volt vehicle source, and/or via a line cord with transformer for a 110-240 volt utility power main.

With flashlight 10 disposed in opening 84 of charger 80 in position for charging battery 70, i.e. with charging contacts making electrical contact within charger sleeve 80, at least a portion of bezel 114 of switch 100 of flashlight 10 is exposed. Thus, when charging of battery 70 takes place, indicator LED 166 of switch 100 produces a visible indication thereof, e.g., produces light that is visible through transparent or translucent bezel 114. Preferably, LED 166 is a red emitting LED and bezel 114 is a translucent and/or transparent red plastic. Typically, when charger 80 is mounted to a vertical or nearly vertical surface, the visible light indication provided by switch 100 is visible over a field of view of about 180° horizontally and over a field of view of more than about 90° vertically.

Figure 5:
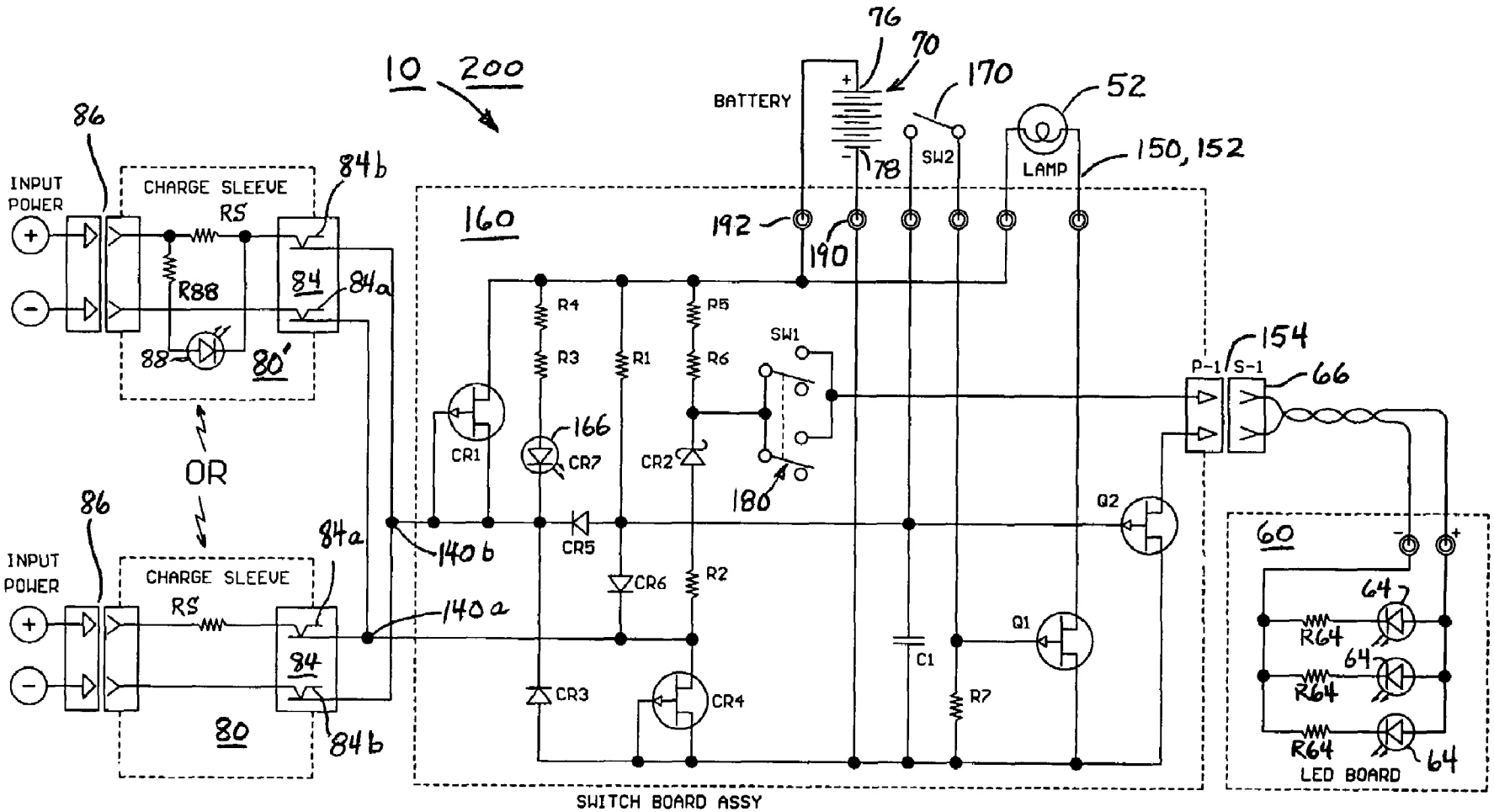
FIG. 5 is an electrical schematic diagram of an example flashlight circuit including the example embodiment of an example switch as is FIGS. 1-3.

FIG. 5 is an electrical schematic diagram of an example flashlight 10 circuit 200 including the example switch 100 as shown in FIGS. 1-3. Circuit board 160, also known as a switch board assembly, includes circuitry for controlling operation of lamp 52 and LEDs 64, and for charging battery 70. Operation of flashlight 10 will be described and then the charging of battery 70 will be described.

Lamp 52 is actuated by closing switch 170, SW2 which applies relatively positive voltage from battery 70 to the gate of FET transistor Q1 via resistors R1, R7 As a result, the drain-source conduction path of FET Q1 is rendered conductive so as to selectively complete a connection of lamp 52 in circuit with battery 70, i.e. between the relatively positive and relatively negative terminals thereof, whereby lamp 52 is selectively energized to produce light. Opening switch 170, SW2 removes the voltage from the gate of FET Q1 causing FET Q1 to become non-conductive thereby to turn lamp 52 off, i.e. lamp 52 is de-energized and no longer produces light. Capacitor C1 connected between the gate of FET Q1 and the relatively negative terminal of battery 70 provides low pass filtering.

Relatively positive voltage from battery 70 is also applied via resistor R1 to the gate of FET transistor Q2. As a result, the drain-source conduction path of FET Q2 is rendered conductive so as to complete a connection of LEDs 64 in circuit with battery 70, i.e. between the relatively negative end of light source 60 and the relatively negative terminal of battery 70, i.e. via connectors 66, 154, P-1, S-1.

LEDS 64 of light source 60, e.g., on LED board 62, are actuated by closing switch 180, SW1 which selectively completes a circuit between the relatively positive and relatively negative terminals 76, 78 of battery 70, a circuit that includes LEDs 64 and series resistors R5, R6, R64 for controlling the current flowing through LEDs 64 via FET Q2. As a result, LEDs 64 are selectively energized to produce light. Preferably, a separate resistor R64 is connected in series with each of LEDs 64 on plastic ring 62 of LED light source 60, and resistors R5, R6 of circuit board 160 are in series with all three of LEDs 64. The combination of resistors R5, R6, R64 cooperate for providing a desired level of LED 64 operating current. Opening switch 180, SW1 removes the voltage from LEDs 64 thereby to turn LEDs 64 of light source 60 off. As a result, LEDs 64 are selectively energized and de-energized to produce light when switch 180, SW1 is closed and to not produce light when switch 180, SW1 is open.

Desirably, a light 10 including an electrical switch 100 would be usable not only with chargers 80 supplied with the light 10, but also with at least one physically similar charger 80' that was provided for use with another light, e.g., wherein both the other light and light 10 will physically fit into charger 80 and into charger 80' in the charging position. A charger 80' provided with another light includes a charging indicator light 88 provided by an LED 88 and a resistor R88 in series therewith. Charger 80' includes a series resistor RS that limits the charging current that can be supplied thereby via physical contacts 84*a* and 84*b*. External input power to energize charger 80' is nominally 12 volts DC with polarity as indicated, e.g., typically from a step-down transformer-rectifier or from vehicle 12 volt DC power.

A charger 80 provided with light 10, for example, does not include a charging indicator light (charging indication is provided by LED 166 of switch 100 of light 10). Charger 80 includes a series resistor RS that limits the charging current that can be supplied thereby via physical contacts 84*a* and 84*b*. External input power to energize charger 80 is nominally 12 volts DC with polarity as indicated, e.g., typically from a step-down transformer-rectifier or from vehicle 12 volt DC power.

Contacts 84*a*, 84*b* of charger 80 are physically located in opening 84 of charger 80 in positions identified as 84*a* and 84*b*, wherein contact 84*a* of charger 80 presents relatively positive voltage to charging contact 140*a* of light 10 and contact 84*b* thereof presents relatively negative voltage to charging contact 140*b* of light 10. On the other hand, contact 84*a* of charger 80' presents relatively negative voltage to charging contact 140*a* and contact 84*b* thereof presents relatively positive voltage to charging contact 140*b*, i.e. the opposite polarity to that of charger 80.

Voltages and potentials described as being positive or negative are relatively positive and relatively negative with respect to each other, irrespective of the potential of a reference or ground. Thus, a +12 volt signal could be referenced to chassis or ground, or could be referenced to any other voltage, e.g., if referenced to a +6 volt potential, "positive" voltage would be at +18 volts and "negative" voltage would be at +6 volts. Most typically, however, the negative terminal is commonly connected to a chassis or a local ground.

So that battery 70 of light 10 may be charged from charger 80 and from charger 80', circuit board 160 includes electronic circuits for charging battery 70 when flashlight 10 is placed into a charger assembly irrespective of the polarity of the voltage presented by that charger. To this end, diodes CR1, CR2, CR3 and CR4 provide a full-wave rectifier receiving input voltage at charging contacts 140*a*, 140*b*.

When light 10 is placed into charger 80 and input voltage is present, relatively positive voltage received at charging contact 140*a* and relatively negative voltage received at charging contact 140*b* cause charging current to flow through battery 70 via resistor R2, diode CR2, resistors R5, R6, and diode CR3. Thus, the value of charging current of battery 70 is determined by the difference between the input voltage to charger 80 and voltage of the battery 70, less the conduction voltages of diodes CR2 and CR3, divided by the combined resistance of resistors RS, R2, R5 and R6. Typically, a charging current at about a nominal C/10 rate is satisfactory for a NiCd battery 70, e.g., about 180 milliamperes for a 1.8 ampere-hour battery 70.

When light 10 is placed into charger 80' and input voltage is present, relatively negative voltage received at charging contact 140*a* and relatively positive voltage received at charging contact 140*b* causes charging current to flow through battery 70 via diode-connected FET CR1 and diode-connected FET CR4. Thus, the value of charging current of battery 70 is determined by the difference between the input voltage to charger 80' and the voltage of battery 70, less the conduction voltages of diode-connected FETs CR1 and CR4, divided by the resistance of resistor RS. Thus, resistor RS of charger 80' will typically have a greater resistance than does resistance RS of charger 80 where it is desired to obtain a similar charging current, e.g., at a C/10 rate.

When light 10 is placed into charger 80 and input voltage is present, the cathode of LED 166, CR7 is at relatively negative potential of contact 140*b* and so LED 166, CR7 is connected across battery 70 with proper polarity to be energized via resistors R3, R4, thereby to produce light indicative of battery charging. If light 10 is removed from charger 80, or if charging voltage is not received at terminals 140*a*, 140*b* thereof from charger 80, or if light 10 is placed in charger 80', then LED 166, CR7 will not be energized.

When light 10 is placed into charger 80' and input voltage is present, relatively positive voltage is present at the cathode of LED 166, CR7 and so LED 166, CR7 is not biased to produce light and no charging indication is provided by LED 166, CR7. Thus, LED 166, CR7 of switch 100 provides a charging indication only when light 10 is placed in charger 80 and power is present to charge battery 70. Also, a charging indication is provided from either switch 100 if light 10 is placed into charger 80 or from LED indicator 88 if light 10 is placed into charger 80', but not from both switch 100 and indicator 88, although dual charging indications, e.g., LEDs 88, 166, could be provided if desired.

When light 10 is placed into charger 80 and input voltage is present, the cathode of diode CR5 is at the relatively negative voltage received at charging contact 140*b*. When light 10 is placed into charger 80' and input voltage is present, the cathode of diode CR6 is at the relatively negative voltage received at charging contact 140*a*. Thus, whether light 10 is placed into charger 80 or into charger 80', the junction at the anodes of diodes CR5, CR6 is substantially at the relatively negative potential. This causes the respective gates of FETs Q1 and Q2 to be biased substantially at the relatively negative potential thereby rendering FETs Q1 and Q2 non-conductive.

As a result, lamp 52 and LEDs 64 are extinguished whether switches 170, 180, SW1, SW2 are positioned to energize either or both of lamp 52 and LEDs 64 or are positioned not to energize lamp 52 and/or LEDs 64. This provides the feature of automatically turning light sources 52, 64 of light 10 OFF when light 10 is placed in an energized charger 80, 80' as well as the additional feature of providing a power failure indication if either or both of switches 170, 180, SW1, SW2 is in the ON position. In other words, if the input power to the charger 80, 80' is removed, then lamp 52 and/or LEDs 64 of light 10 will turn ON if any of switches 170, 180, SW1, SW2 is in the ON position.

It is noted that resistors R5, R6 of circuit board 160 provide two functions, e.g., the ballasting of LEDs 64 when light 10 is operated and the limiting of charging current when battery 70 of light 10 is being charged by charger 80.

Terminals 76, 78 of battery 70 connect to circuit board 160 via springs 192, 190, respectively. Lamp 52 connects to circuit board 160 via wires 150 and connectors 152. LED light source 60 connects to circuit board 160 via connectors 66, 154, P-1, S-1. Input power is connected to chargers 80, 80' via line cord and/or connector 86.

An electrical switch arrangement 100, 100 may comprise an appliance housing 20 including an electrical operating device 60, the appliance housing 20 having a cavity for receiving a battery 70 and having an opening 26 in a wall thereof for receiving an electrical switch 100, and an electrical switch 100 for selectively operating electrical operating device 60. Switch 100 comprises a switch housing 110 including a bezel 114 wherein at least the bezel 114 is translucent or transparent or is translucent and transparent, the bezel 114 having first and second cavities 118, 116 spaced apart in a front-facing side thereof and having a third cavity in a rear-facing side thereof between the first and second cavities 118, 116, first and second actuators 130, 120 each having a respective actuator member 172, 182 for actuating at least one set of electrical contacts 170, 180 for selectively making and breaking an electrical connection between the electrical contacts thereof for selectively operating electrical operating device 60, first actuator 130 being disposed in the first cavity 118 of bezel 114 of switch housing 110 with its actuator member 172 towards the front-facing side thereof and second actuator 120 being disposed in the second cavity 116 of bezel 114 of switch housing 110 with its actuator member 182 towards the front-facing side thereof, and an indicator light source 166 for selectively producing light to indicate an operating condition, wherein indicator light source 166 is disposed in the third cavity of bezel 114 of switch housing 110 between the first and second actuators 130, 120, wherein the light produced by indicator light source 166 is visible through bezel 114 of switch housing 110, wherein bezel 114 of electrical switch 100 is disposed in the opening 26 in appliance housing 20 with first and second actuators 130, 120 exposed exterior to appliance housing 20, and wherein indicator light source 166 is selectively connected in circuit with battery 70. Electrical operating device 60 may include at least first and second light sources 52, 64, wherein the electrical contacts 170 of first actuator 130 actuates first light source 52 and the electrical contacts 180 of second actuator 120 actuates second light source 64. First light source 52 may be an incandescent light source 52 and second light source 64 may be a solid state light source 64. Switch housing 110 may include a back structure 120 shaped to conform with the wall of appliance housing 20 proximate the opening 26 therein. Indicator light source 166 may be connected in circuit with battery 70. Battery 70 may be rechargeable, and indicator light source 166 may be connected in circuit with rechargeable battery 70 to produce light when rechargeable battery 70 is charging. Electrical switch arrangement 10, 100 may further comprise an electrical circuit board 160 adjacent the rear-facing side of switch housing 110, wherein circuit board 160 may support indicator light source 166 and at least one of first and second actuators 172, 182.

An electrical switch arrangement 10, 100 may comprise a flashlight housing 20 including first and second light sources 52, 64, flashlight housing 20 having a cavity for receiving a battery 70 and having an opening 26 in a wall thereof for receiving an electrical switch 100, and an electrical switch assembly 100 for selectively operating first and second light sources 52, 64. Switch assembly 100 may comprise a switch housing 110 including a bezel 114 wherein at least the bezel 114 is translucent or transparent or is translucent and transparent, the bezel 114 having first and second cavities 118, 116 spaced apart in a front-facing side thereof and having a third cavity in a rear-facing side thereof between the first and second cavities 118, 116, first and second actuators 130, 120 each having a respective actuator member 172, 182 for actuating at least one set of electrical contacts 170, 180 for selectively making and breaking an electrical connection between the electrical contacts 170, 180 thereof for selectively operating first and second light sources 52, 64, first actuator 130 being disposed in the first cavity 118 of bezel 114 of switch housing 110 with its actuator member 172 towards the front-facing side thereof for actuating first light source 52 and second actuator 120 being disposed in the second cavity 116 of bezel 114 of switch housing 110 with its actuator member 182 towards the front-facing side thereof for actuating second light source 64, and an indicator light source 166 for selectively producing light to indicate an operating condition, wherein indicator light source 166 is disposed in the third cavity of bezel 114 of switch housing 110 between the first and second actuators 130, 120, wherein the light produced by indicator light source 166 is visible through bezel 114 of switch housing 110, wherein bezel 114 of electrical switch 100 is disposed in the opening 26 in flashlight housing 20 with first and second actuators 130, 120 exposed exterior to flashlight housing 20, and wherein indicator light source 166 is selectively connected in circuit with battery 70. First light source 52 may be an incandescent light source 52 and second light source 64 may be a solid state light source 64. Switch housing 110 may include a back structure 120 shaped to conform with the wall of flashlight housing 20 proximate the opening 26 therein. Indicator light source 166 may be connected in circuit with battery 70. Battery 70 may be rechargeable, and indicator light source 166 may be connected in circuit with rechargeable battery 70 to produce light when rechargeable battery 70 is charging. Electrical switch arrangement 10, 100 may further comprise an electrical circuit board 160 adjacent the rear-facing side of switch housing 110, and circuit board 160 may support indicator light source 166 and at least one of first and second actuators 172, 182. Electrical switch arrangement 10, 100 may further comprise a first flexible button 130 disposed in the first cavity 118 of switch housing 110 for covering first actuator 172, or a second flexible button 120 disposed in the second cavity 116 of switch housing for covering second actuator 182, or first and second flexible buttons 130, 120 disposed respectively in the first and second cavities 118, 116 of switch housing 110 for covering first and second actuators 172, 182, respectively, or a flexible gasket 135 surrounding bezel 114 of switch housing 110 at the opening 26 of flashlight housing 20 for providing a seal between switch housing 110 and flashlight housing 20, or any combination of any of the foregoing.

An electrical switch 100 may comprise a switch housing 110 including a bezel 114 wherein at least the bezel 114 is translucent or transparent or is translucent and transparent, the bezel 114 having first and second cavities 118, 116 spaced apart in a front-facing side thereof and having a third cavity in a rear-facing side thereof between the first and second cavities 118, 116, first and second actuators 130, 120 each having a respective actuator member 172, 182 for actuating at least one set of electrical contacts 170, 180 for selectively making and breaking an electrical connection between the electrical contacts 170, 180 thereof, first actuator 130 being disposed in first cavity 118 of bezel 114 of switch housing 110 with its actuator member 172 towards the front-facing side thereof for actuating a first electrical device 52 and second actuator 120 being disposed in the second cavity 116 of bezel 114 of switch housing 110 with its actuator member 182 towards the front-facing side thereof for actuating a second electrical device 64, and an indicator light source 166 for selectively producing light, wherein indicator light source 166 is disposed in the third cavity of bezel 114 of switch housing 110 between first and second actuators 130, 120, and the light produced by indicator light source 166 is visible through bezel 114 of switch housing 110. Electrical switch arrangement 100 may be in combination with a body 20 having an opening 26 in a wall thereof, wherein bezel 114 of translucent switch housing 110 may be disposed in the opening 26 in the wall of body 20. Translucent switch housing 110 may include a back structure 120 contoured with the wall of body 20.

An electrical switch arrangement 100 may comprise a switch housing 110 including a bezel 114 wherein at least the bezel 114 is translucent or transparent or is translucent and transparent, the bezel 114 having first and second cavities spaced apart in a front-facing side thereof and having a third cavity in a rear-facing side thereof between the first and second cavities, first and second actuators 130, 120 each having a respective actuator member 172, 182 for actuating at least one set of electrical contacts 170, 180 for selectively making and breaking an electrical connection between the electrical contacts 170, 180 thereof for selectively operating first and second operating electrical devices 52, 64, first actuator 130 being disposed in the first cavity 118 of bezel 114 of switch housing 110 with its actuator member 172 towards the front-facing side thereof for actuating first electrical device 52 and second actuator 130 being disposed in the second cavity 116 of bezel 114 of switch housing 110 with its actuator member 182 towards the front-facing side thereof for selectively actuating second electrical device 64, and an indicator light source 166 for selectively producing light to indicate an operating condition, wherein indicator light source 166 is disposed in the third cavity of bezel 114 of switch housing 110 between the first and second actuators 130, 120, wherein the light produced by indicator light source 166 is visible through bezel 114 of switch housing 110, wherein first and second actuators 130, 120 are accessible for actuating the first and second electrical devices 52, 64, and wherein indicator light source 166 is connected in circuit for indicating an operating condition. Switch housing 110 may include a back structure 120 shaped to conform with a surface of an object 20 with which it may be utilized. Electrical switch arrangement 100 may further comprise an electrical circuit board 160 adjacent the rear-facing side of switch housing 110, wherein circuit board 160 may support indicator light source 166 and at least one of first and second actuators 172, 182. Electrical circuit board 160 may comprise at least one wire 150 for connecting to one of first and second electrical devices 52, 64, or at least one connector 152 for connecting to one of first and second electrical devices 52, 64, or at least one wire 150 for connecting to one of first and second electrical devices 52, 64 and at least one connector 152 for connecting to the other of the first and second electrical devices 52, 64. Electrical switch arrangement 100 may further comprise first and second electrical contacts 140 disposed on the front-facing side of switch housing 110 between the first and second cavities 118, 116 thereof, and first and second concentric electrically conductive coil springs 190, 192 connected respectively to first and second electrical contacts 140. Electrical switch arrangement 100 may further comprise a first flexible button 130 disposed in the first cavity 118 of switch housing 110 for covering first actuator 172, or a second flexible button 120 disposed in the second cavity 116 of switch housing 110 for covering second actuator 182, or first and second flexible buttons 130, 120 disposed respectively in the first and second cavities 118, 116 of switch housing 110 for covering first and second actuators 172, 182, respectively, or a flexible gasket 135 surrounding bezel 114 of switch housing 110 for providing a seal for switch housing 110, or any combination of any of the foregoing.

An electrical switch arrangement 100 may comprise a switch housing 110 including a generally rectangular bezel 114 wherein at least the generally rectangular bezel 114 is translucent or transparent or is translucent and transparent, the generally rectangular bezel 114 having first and second cavities 118, 116 spaced apart in a front-facing side thereof and having a third cavity in a rear-facing side thereof between the first and second cavities 118, 116, first and second actuators 130, 120 each having a respective actuator member 172, 182 for actuating at least one set of electrical contacts 170, 180 for selectively making and breaking an electrical connection between the electrical contacts 170, 180 thereof for selectively operating first and second operating electrical devices 52, 64, first actuator 130 being disposed in the first cavity 118 of generally rectangular bezel 114 of switch housing 110 with its actuator member 172 towards the front-facing side thereof for actuating first electrical device 52 and second actuator 120 being disposed in the second cavity 116 of generally rectangular bezel 114 of switch housing 110 with its actuator member 182 towards the front-facing side thereof for selectively actuating second electrical device 64, and an indicator light source 166 for selectively producing light to indicate an operating condition, wherein indicator light source 166 is disposed in the third cavity of generally rectangular bezel 114 of switch housing 110 between the first and second actuators 130, 120, wherein the light produced by indicator light source 166 is visible through generally rectangular bezel 114 of switch housing 110, an electrical circuit board 160 adjacent the rear-facing side of switch housing 110, wherein circuit board 160 supports indicator light source 166 and at least one of first and second actuators 172, 182; and first and second electrically conductive posts 145 having respective first ends 140 exposed on the front-facing side of switch housing 110 between the first and second cavities 118, 116 thereof, and having respectively second ends 145 connected to electrical circuit board 160, wherein first and second actuators 130, 120 are accessible for actuating the first and second electrical devices 52, 64, and wherein indicator light source 166 is connected in circuit with at least one of first and second electrically conductive posts 145 for indicating an operating condition. Electrical circuit board 160 may comprise at least one wire 150 for connecting to one of the first and second electrical devices 52, 64, or at least one connector 152 for connecting to one of the first and second electrical devices 52, 64, or at least one wire 150 for connecting to one of the first and second electrical devices 52, 64 and at least one connector 152 for connecting to the other of the first and second electrical devices 52, 64. Electrical switch arrangement 100 may further comprise first and second concentric electrically conductive coil springs 190, 192 connected respectively to first and second electrical posts 145 via electrical circuit board 160. Electrical switch arrangement 100 may further comprise a first flexible button 130 disposed in the first cavity 118 of switch housing 110 for covering first actuator 172, or a second flexible button 120 disposed in the second cavity 116 of switch housing 110 for covering second actuator 182, or first and second flexible buttons 130, 120 disposed respectively in the first and second cavities 118, 116 of switch housing 110 for covering first and second actuators 172, 182, respectively; or a flexible gasket 135 surrounding bezel 114 of switch housing 110 for providing a seal for switch housing 110, or any combination of any of the foregoing.

An electrical switch arrangement 100 may comprise at least one actuator 172 or 182 having a actuator surface 130 or 120 for actuating at least one set of electrical contacts 170 or 180 for selectively making and breaking an electrical connection between the electrical contacts 170 or 180, an indicator light source 166 proximate actuator 172 or 182 for selectively producing light, and a translucent or transparent or translucent and transparent switch housing 110 supporting actuator 172 or 182 so that actuator surface 130 or 120 is exposed and actuator 172 or 182 may be actuated, translucent and/or transparent switch housing 110 covering indicator light source 166 and being translucent or transparent or translucent and transparent to the light produced by indicator light source 166, wherein indicator light source 166 is disposed adjacent translucent and/or transparent switch housing 110 so that indicator light source 166 is visible through translucent and/or transparent switch housing 110 when indicator light source 166 is producing light. Translucent and/or transparent switch housing 110 may have two opposing translucent and/or transparent surfaces 114*a*, 114*b*, and wherein indicator light source 166 may be visible through the two opposing translucent and/or transparent surfaces 114*a*, 114*b* of translucent and/or transparent switch housing 110 when indicator light source 166 is producing light. Electrical switch arrangement 100 may further comprise a rechargeable battery 70, wherein indicator light source 166 may be to controlled to produce light only when rechargeable battery 70 is being charged. Electrical switch arrangement 100 may further comprise a flexible button 130 or 120 disposed in translucent and/or transparent switch housing 110 for covering at least one actuator 172 or 182, or a flexible gasket 135 surrounding translucent and/or transparent switch housing 110 for providing a seal for translucent and/or transparent switch housing 110, or any combination of the foregoing.

In one preferred embodiment, an electrical switch 100 of the sort shown and described is utilized in a type SL-20XP-LED flashlight available from Streamlight, Inc. of Eagleville, Pa. The SL-20XP-LED flashlight employs one halogen lamp 54 centrally located in a generally parabolic reflector 50 and that is energized and de-energized by actuating switch button 130 via wires 150, and has three white LEDs 64 located near the periphery of the reflector 50 arrayed around the halogen lamp 54 in reflector 50 and that are energized and de-energized via connectors 66, 154 by actuating LED button 120. A 6-volt battery 70 including five 1.2 volt rechargeable nickel-cadmium (Ni—Cd) or nickel-metal-hydride (NiMH) batteries 72 provide electrical power to energize the halogen lamp 54 and/or the three LEDs 64 to produce light as a user may desire. A red or white light emitting LED 166 can produce a red glow over much of bezel 114 when the flashlight 10 is positioned in its charging station 80 and the batteries 70, 72 are being charged. The red charge indicating light is visible through both sides 114*a*, 114*b* of bezel 114, e.g., over more than a 180° viewing angle. The SL-20XP-LED light and its specifications may be viewed at www.streamlight.com, the website of Streamlight, Inc.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

While the present invention has been described in terms of the foregoing example embodiments, variations within the scope and spirit of the present invention as defined by the claims following will be apparent to those skilled in the art. For example, while the entire switch housing 100 may be of a material that is translucent and/or transparent to the light produced by the charging indicator 166, it is sufficient that the material of the bezel or frame 114 be of such translucent and/or transparent material.

In addition, while the example electrical switch arrangement 100 is described herein in the context of utilization as an electrical switch for an example flashlight, e.g., flashlight 10, the electrical switch arrangement described may be employed in any appliance having an illuminating indicator, e.g. such as a charging indicator for a rechargeable battery, or any other appliance.

While the example switch arrangement described includes two actuator buttons, an electrical switch according to the present arrangement may have a fewer or a greater number of actuators, as may be necessary or convenient for the flashlight or other appliance with which it may be utilized. While push-button actuators are described, other types of actuators, e.g., a rotary switch or a toggle switch, could be utilized.

The indicator LED 166 may emit red light to complement a translucent and/or transparent red bezel 114, or may emit any other color light that will pass through the translucent and/or transparent bezel 114. Typically, and preferably, the color of the translucent and/or transparent material of the bezel 114 will be the same as or similar to the color of the light emitted by the indicator LED 166, but may also be clear, transparent or translucent white.

Finally, numerical values stated are typical or example values, and are not limiting values. For example, any number of lamps or solid state light sources or LEDs or combinations thereof, or a battery or batteries comprising any desired number of cells or batteries, may be employed.

What is claimed is:

1. An electrical switch arrangement comprising:

an appliance housing including an electrical operating device, said appliance housing having a cavity for receiving a battery and having an opening in a wall thereof for receiving an electrical switch; and an electrical switch for selectively operating said electrical operating device comprising:

a switch housing including a bezel wherein at least the bezel is translucent or transparent or is translucent and transparent, the bezel having first and second cavities spaced apart in a front-facing side thereof and having a third cavity in a rear-facing side thereof between the first and second cavities;

first and second actuators each having a respective actuator member for actuating at least one set of electrical contacts for selectively making and breaking an electrical connection between the electrical contacts thereof for selectively operating said electrical operating device, said first actuator being disposed in the first cavity of the bezel of said switch housing with its actuator member towards the front-facing side thereof and said second actuator being disposed in the second cavity of the bezel of said switch housing with its actuator member towards the front-facing side thereof; and an indicator light source for selectively producing light to indicate an operating condition, wherein said indicator light source is disposed in the third cavity of the bezel of said switch housing between the first and second actuators, wherein the light produced by said indicator light source is visible through the bezel of said switch housing, wherein the bezel of said electrical switch is disposed in the opening in said appliance housing with said first and second actuators exposed exterior to said appliance housing, and wherein said indicator light source is selectively connected in circuit with said battery, whereby light produced by the indicator light source to indicate an operating condition is visible through the translucent and/or transparent bezel of the switch housing and the indicator light source is not visible through the switch housing unless said indicator light source is producing light.

2. The electrical switch arrangement of claim 1 wherein said electrical operating device includes at least first and second light sources, wherein the electrical contacts of said first actuator actuates said first light source and the electrical contacts of said second actuator actuates said second light source.

3. The electrical switch arrangement of claim 2 wherein said first light source is an incandescent light source and wherein said second light source is a solid state light source.

4. The electrical switch arrangement of claim 1 wherein said switch housing includes a back structure shaped to conform with the wall of said appliance housing proximate the opening therein.

5. The electrical switch arrangement of claim 1 wherein said indicator light source is connected in circuit with the battery.

6. The electrical switch arrangement of claim 1 wherein the battery is rechargeable, and wherein said indicator light source is connected in circuit with the rechargeable battery to produce light when the rechargeable battery is charging.

7. The electrical switch arrangement of claim 1 further comprising an electrical circuit board adjacent the rear-facing side of said switch housing, wherein said circuit board supports said indicator light source and at least one of said first and second actuators.

8. An electrical switch arrangement comprising:

a flashlight housing including first and second light sources, said flashlight housing having a cavity for receiving a battery and having an opening in a wall thereof for receiving an electrical switch; and an electrical switch assembly for selectively operating said first and second light sources comprising:

a switch housing including a bezel wherein at least the bezel is translucent or transparent or is translucent and transparent, the bezel having first and second cavities spaced apart in a front-facing side thereof and having a third cavity in a rear-facing side thereof between the first and second cavities;

first and second actuators each having a respective actuator member for actuating at least one set of electrical contacts for selectively making and breaking an electrical connection between the electrical contacts thereof for selectively operating said first and second light sources, said first actuator being disposed in the first cavity of the bezel of said switch housing with its actuator member towards the front-facing side thereof for actuating said first light source and said second actuator being disposed in the second cavity of the bezel of said switch housing with its actuator member towards the front-facing side thereof for actuating said second light source; and an indicator light source for selectively producing light to indicate an operating condition, wherein said indicator light source is disposed in the third cavity of the bezel of said switch housing between the first and second actuators, wherein the light produced by said indicator light source is visible through the bezel of said switch housing, wherein the bezel of said electrical switch is disposed in the opening in said flashlight housing with said first and second actuators exposed exterior to said flashlight housing, and wherein said indicator light source is selectively connected in circuit with said battery, whereby light produced by the indicator light source to indicate an operating condition is visible through the translucent and/or transparent bezel of the switch housing and the indicator light source is not visible through the switch housing unless said indicator light source is producing light.

9. The electrical switch arrangement of claim 8 wherein said first light source is an incandescent light source and wherein said second light source is a solid state light source.

10. The electrical switch arrangement of claim 8 wherein said switch housing includes a back structure shaped to conform with the wall of said flashlight housing proximate the opening therein.

11. The electrical switch arrangement of claim 8 wherein said indicator light source is connected in circuit with the battery.

12. The electrical switch arrangement of claim 8 wherein the battery is rechargeable, and wherein said indicator light source is connected in circuit with the rechargeable battery to produce light when the rechargeable battery is charging.

13. The electrical switch arrangement of claim 8 further comprising an electrical circuit board adjacent the rear-facing side of said switch housing, wherein said circuit board supports said indicator light source and at least one of said first and second actuators.

14. The electrical switch arrangement of claim 8 further comprising:

a first flexible button disposed in the first cavity of said switch housing for covering said first actuator, or a second flexible button disposed in the second cavity of said switch housing for covering said second actuator, or first and second flexible buttons disposed respectively in the first and second cavities of said switch housing for covering said first and second actuators, respectively; or a flexible gasket surrounding said bezel of said switch housing at the opening of said flashlight housing for providing a seal between said switch housing and said flashlight housing; or any combination of any of the foregoing.

15. An electrical switch comprising:

a switch housing including a bezel wherein at least the bezel is translucent or transparent or is translucent and transparent, the bezel having first and second cavities spaced apart in a front-facing side thereof and having a third cavity in a rear-facing side thereof between the first and second cavities;

first and second actuators each having a respective actuator member for actuating at least one set of electrical contacts for selectively making and breaking an electrical connection between the electrical contacts thereof, said first actuator being disposed in the first cavity of the bezel of said switch housing with its actuator member towards the front-facing side thereof for actuating a first electrical device and said second actuator being disposed in the second cavity of the bezel of said switch housing with its actuator member towards the front-facing side thereof for actuating a second electrical device; and an indicator light source for selectively producing light, wherein said indicator light source is disposed in the third cavity of the bezel of said switch housing between the first and second actuators, and the light produced by said indicator light source is visible through the bezel of said switch housing, whereby light produced by the indicator light source is visible through the translucent and/or transparent bezel of the switch housing and the indicator light source is not visible through the switch housing unless said indicator light source is producing light.

16. The electrical switch arrangement of claim 15 in combination with a body having an opening in a wall thereof, wherein the bezel of said translucent switch housing is disposed in the opening in the wall of said body.

17. The electrical switch arrangement of claim 16 wherein said translucent switch housing includes a back structure contoured with the wall of said body.

18. An electrical switch arrangement comprising:

a switch housing including a bezel wherein at least the bezel is translucent or transparent or is translucent and transparent, the bezel having first and second cavities spaced apart in a front-facing side thereof and having a third cavity in a rear-facing side thereof between the first and second cavities;

first and second actuators each having a respective actuator member for actuating at least one set of electrical contacts for selectively making and breaking an electrical connection between the electrical contacts thereof for selectively operating first and second operating electrical devices, said first actuator being disposed in the first cavity of the bezel of said switch housing with its actuator member towards the front-facing side thereof for actuating said first electrical device and said second actuator being disposed in the second cavity of the bezel of said switch housing with its actuator member towards the front-facing side thereof for selectively actuating said second electrical device; and an indicator light source for selectively producing light to indicate an operating condition, wherein said indicator light source is disposed in the third cavity of the bezel of said switch housing between the first and second actuators, wherein the light produced by said indicator light source is visible through the bezel of said switch housing, wherein said first and second actuators are accessible for actuating the first and second electrical devices, and wherein said indicator light source is connected in circuit for indicating an operating condition, whereby light produced by the indicator light source to indicate an operating condition is visible through the translucent and/or transparent bezel of the switch housing and the indicator light source is not visible through the switch housing unless said indicator light source is producing light.

19. The electrical switch arrangement of claim 18 wherein said switch housing includes a back structure shaped to conform with a surface of an object with which it is to be utilized.

20. The electrical switch arrangement of claim 18 further comprising an electrical circuit board adjacent the rear-facing side of said switch housing, wherein said circuit board supports said indicator light source and at least one of said first and second actuators.

21. The electrical switch arrangement of claim 20 wherein said electrical circuit board comprises:

at least one wire for connecting to one of the first and second electrical devices; or at least one connector for connecting to one of the first and second electrical devices; or at least one wire for connecting to one of the first and second electrical devices and at least one connector for connecting to the other of the first and second electrical devices.

22. The electrical switch arrangement of claim 18 further comprising first and second electrical contacts disposed on the front-facing side of said switch housing between the first and second cavities thereof, and first and second concentric electrically conductive coil springs connected respectively to said first and second electrical contacts.

23. The electrical switch arrangement of claim 18 further comprising:

a first flexible button disposed in the first cavity of said switch housing for covering said first actuator, or a second flexible button disposed in the second cavity of said switch housing for covering said second actuator, or first and second flexible buttons disposed respectively in the first and second cavities of said switch housing for covering said first and second actuators, respectively; or a flexible gasket surrounding said bezel of said switch housing for providing a seal for said switch housing; or any combination of any of the foregoing.

24. An electrical switch arrangement comprising:

a switch housing including a generally rectangular bezel wherein at least the generally rectangular bezel is translucent or transparent or is translucent and transparent, the generally rectangular bezel having first and second cavities spaced apart in a front-facing side thereof and having a third cavity in a rear-facing side thereof between the first and second cavities;

first and second actuators each having a respective actuator member for actuating at least one set of electrical contacts for selectively making and breaking an electrical connection between the electrical contacts thereof for selectively operating first and second operating electrical devices, said first actuator being disposed in the first cavity of the generally rectangular bezel of said switch housing with its actuator member towards the front-facing side thereof for actuating said first electrical device and said second actuator being disposed in the second cavity of the generally rectangular bezel of said switch housing with its actuator member towards the front-facing side thereof for selectively actuating said second electrical device; and an indicator light source for selectively producing light to indicate an operating condition, wherein said indicator light source is disposed in the third cavity of the generally rectangular bezel of said switch housing between the first and second actuators, wherein the light produced by said indicator light source is visible through the generally rectangular bezel of said switch housing, an electrical circuit board adjacent the rear-facing side of said switch housing, wherein said circuit board supports said indicator light source and at least one of said first and second actuators; and first and second electrically conductive posts having respective first ends exposed on the front-facing side of said switch housing between the first and second cavities thereof, and having respectively second ends connected to said electrical circuit board;

wherein said first and second actuators are accessible for actuating the first and second electrical devices, and wherein said indicator light source is connected in circuit with at least one of said first and second electrically conductive posts for indicating an operating condition, whereby light produced by the indicator light source to indicate an operating condition is visible through the translucent and/or transparent generally rectangular bezel of the switch housing and the indicator light source is not visible through the switch housing unless said indicator light source is producing light.

25. The electrical switch arrangement of claim 24 wherein said electrical circuit board comprises:

at least one wire for connecting to one of the first and second electrical devices; or at least one connector for connecting to one of the first and second electrical devices; or at least one wire for connecting to one of the first and second electrical devices and at least one connector for connecting to the other of the first and second electrical devices.

26. The electrical switch arrangement of claim 24 further comprising first and second concentric electrically conductive coil springs connected respectively to said first and second electrical posts via said electrical circuit board.

27. The electrical switch arrangement of claim 24 further comprising:

a first flexible button disposed in the first cavity of said switch housing for covering said first actuator, or a second flexible button disposed in the second cavity of said switch housing for covering said second actuator, or first and second flexible buttons disposed respectively in the first and second cavities of said switch housing for covering said first and second actuators, respectively; or a flexible gasket surrounding said bezel of said switch housing for providing a seal for said switch housing; or any combination of any of the foregoing.

28. An electrical switch arrangement comprising:

at least one actuator having a actuator surface for actuating at least one set of electrical contacts for selectively making and breaking an electrical connection between the electrical contacts;

an indicator light source proximate said actuator for selectively producing light; and a translucent or transparent or translucent and transparent switch housing supporting said actuator so that said actuator surface is exposed and said actuator may be actuated, said translucent and/or transparent switch housing covering said indicator light source and being translucent or transparent or translucent and transparent to the light produced by said indicator light source, wherein said indicator light source is disposed adjacent said translucent and/or transparent switch housing so that said indicator light source is visible through said translucent and/or transparent switch housing when said indicator light source is producing light.

29. The electrical switch arrangement of claim 28 wherein said translucent and/or transparent switch housing has two opposing translucent and/or transparent surfaces, and wherein said indicator light source is visible through the two opposing translucent and/or transparent surfaces of said translucent and/or transparent switch housing when said indicator light source is producing light.

30. The electrical switch arrangement of claim 28 further comprising a rechargeable battery, wherein said indicator light source is to controlled to produce light only when said rechargeable battery is being charged.

31. The electrical switch arrangement of claim 28 further comprising:

a flexible button disposed in said translucent and/or transparent switch housing for covering said at least one actuator; or a flexible gasket surrounding said translucent and/or transparent switch housing for providing a seal for said translucent and/or transparent switch housing; or any combination of the foregoing.

* * * * *

UNITED STATES PATENT AND TRADEMARK OFFICE

CERTIFICATE OF CORRECTION

PATENT NO. : 7,582,838 B2
APPLICATION NO. : 11/400615
DATED : September 1, 2009
INVENTOR(S) : Raymond L. Sharrah It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 752 days.

Signed and Sealed this

Fourteenth Day of September, 2010

David J. Kappos

David J. Kappos
*Director of the United States Patent and Trademark Office*